US009954285B2

(12) United States Patent
Chuang et al.

(10) Patent No.: US 9,954,285 B2
(45) Date of Patent: Apr. 24, 2018

(54) WIFI PATCH ANTENNA WITH DUAL U-SHAPED SLOTS

(71) Applicant: Taoglas Group Holdings Limited, Wexford (IE)

(72) Inventors: Chen-yi Chuang, Zhongli (TW); Ronan Quinlan, Wexford (IE)

(73) Assignee: TAOGLAS GROUP HOLDINGS LIMITED, Wexford (IE)

( * ) Notice: Subject to any disclaimer, the term of this patent is extended or adjusted under 35 U.S.C. 154(b) by 0 days.

(21) Appl. No.: 14/853,996

(22) Filed: Sep. 14, 2015

(65) Prior Publication Data

US 2016/0079676 A1 Mar. 17, 2016

Related U.S. Application Data

(60) Provisional application No. 62/049,873, filed on Sep. 12, 2014.

(51) Int. Cl.

| | |
|---|---|
| ***H01Q 13/10*** | (2006.01) |
| ***H01Q 5/357*** | (2015.01) |
| ***H01Q 9/04*** | (2006.01) |

(52) U.S. Cl.

CPC ..... *H01Q 13/106* (2013.01); *H01Q 5/357* (2015.01); *H01Q 9/0407* (2013.01)

(58) Field of Classification Search

CPC ..... H01Q 13/10; H01Q 21/064; H01Q 21/24; H01Q 1/38

USPC ..... 343/770, 768, 767, 746

See application file for complete search history.

(56) References Cited

U.S. PATENT DOCUMENTS

2005/0253767 A1* 11/2005 Liu ..... H01Q 13/106 343/770

2010/0019976 A1* 1/2010 Sakiyama ..... H01Q 9/0442 343/700 MS

FOREIGN PATENT DOCUMENTS

JP EP 1276170 A1 * 1/2003 ..... H01Q 1/36

* cited by examiner

*Primary Examiner* — Dameon E Levi
*Assistant Examiner* — Collin Dawkins
(74) *Attorney, Agent, or Firm* — Coastal Patent Law Group, P.C.

(57) ABSTRACT

The disclosure concerns a microstrip patch antenna configured for operation in the WiFi bands, including 2.4 GHz and 5.2/5.8 GHz. The microstrip patch antenna includes a pair of opposing u-shaped slots embedded in the patch conductor. The patch includes a patch width configured to provide a resonance at 2.4 GHz, and a slot width configured to provide a resonance at 5.2/5.8 GHz. Thus, the antenna provides a dual band WiFi patch antenna.

8 Claims, 6 Drawing Sheets

WIFI PATCH ANTENNA WITH DUAL U-SHAPED SLOTS

CROSS-REFERENCE TO RELATED APPLICATIONS

This application claims benefit of priority with U.S. Ser. No. 62/049,873, filed Sep. 12, 2014, titled "U-SLOT WIFI PATCH ANTENNA"; the contents of which are hereby incorporated by reference.

BACKGROUND OF THE INVENTION

Field of the Invention

This invention relates to antennas for wireless communications, and more particularly, to a WiFi patch antenna including dual opposing u-shaped slots and configured for 2.4 GHz and 5.2/5.8 GHz band resonances.

Description of the Related Art

Microstrip patch antennas are well known and used in the art.

Generally, a microstrip patch antenna generally includes a thin sheet of conductor (typically copper, but often can be another conductive metal). The conductor is often positioned on a top surface of a substrate, and the patch/substrate combination is usually applied above a ground plane. A feed substrate may be combined with the ground plane depending on the desired characteristics.

There is a significant demand for patch antennas designed for Wireless Local Area Network (WLAN), otherwise known as "Wi-Fi", including resonances at 2.4/5.2/5.8 GHz.

Microstrip patch antennas, including variations with slots and without slots, are disclosed by Sivakumar et al., "*Bandwidth enhancement of rectangular microstrip patch antenna using slots", IOSR Journal of Electronics and Communication Engineering* (*IOSR-JECE*) *e-ISSN:* 2278-2834, *p-ISSN:* 2278-8735. Volume 6, Issue 1 (May-June 2013), PP 07-10. As disclosed by Sivakumar, the dimensions of the radiating structure, patch width, and the feed point position are chosen according to the required frequency of operation.

Further, Ghalibafan et al., "*A NEW DUAL-BAND MICROSTRIP ANTENNA WITH U-SHAPED SLOT", Progress In Electromagnetics Research C*, Vol. 12, 215{223, 2010", discloses a microstrip antenna with a u-shaped slot. As disclosed by Ghalibafan et al., in some applications, it is desired to have a dual band or multiband characteristics. These characteristics can be obtained by coupling multiple radiating elements or by using tuning devices such as varactor diodes. However, these methods make antenna more complicated. A simple method to achieve the dual band characteristic in a microstrip antenna is embedding a slot in the patch as the structure proposed in which the radiating patch includes a pair of step-slots. In microstrip antennas, embedded slots can also be used to enhance the impedance bandwidth of a single band antenna.

Other examples of WLAN patch antennas are disclosed by Wang et al. "*A NOVEL DUAL-BAND PATCH ANTENNA FOR WLAN COMMUNICATION", Progress In Electromagnetics Research C*, Vol. 6, 93 {102, 2009.

While microstrip patch antennas are widely known and form a crowded art, there remains a need for new antenna structures for providing additional resonances, smaller form factor, improved efficiency, improved impedance characteristics, and other improvements as would be recognized by those with skill in the art.

SUMMARY OF THE INVENTION

A microstrip patch antenna is disclosed having a pair of opposing u-shaped slots embedded therein. The antenna is configured to operate in the Wi-Fi dual band (2.4 GHz and 5.2 GHz/5.8 GHz).

The antenna can be optimized for desired performance by varying one or more of: the width of the opposing u-shaped slots, the patch dimension and the feed point location. The patch dimension, the width of the slot and the feed point are used to control the resonant frequency and the impedance in the operation band.

The disclosed embodiments provide a relatively small-sized patch antenna for Wi-Fi dual band applications which is configured for mounting on the surface of a device.

DETAILED DESCRIPTION OF THE PREFERRED EMBODIMENTS

For purposes of explanation and not limitation, details and descriptions of certain preferred embodiments are hereinafter provided such that one having ordinary skill in the art may be enabled to make and use the invention. These details and descriptions are representative only of certain preferred embodiments, however, and a myriad of other embodiments which will not be expressly described will be readily obvious to those of skill in the art upon a thorough review hereof. Accordingly, any reviewer of the instant disclosure should interpret the scope of the invention by the claims, and such scope shall not be limited by the embodiments described and illustrated herein.

Now, in accordance with an embodiment of the invention, a microstrip patch antenna is disclosed. The microstrip patch antenna comprises a patch conductor having a length dimension and a width dimension, wherein an area defined by the length and width of the conductor forms the microstrip patch. In addition, the patch conductor comprises a first u-shaped slot configured in a first orientation, and a second u-shaped conductor configured in a second orientation opposite of the first orientation such that the first u-shaped slot is oriented to oppose the second u-shaped slot. The antenna further comprises an antenna feed positioned in a manner to optimize impedance characteristics of the antenna. Additionally, the microstrip patch antenna is positioned on a dielectric substrate having a desired thickness and permittivity to optimize antenna size and impedance characteristics.

Figure 1:
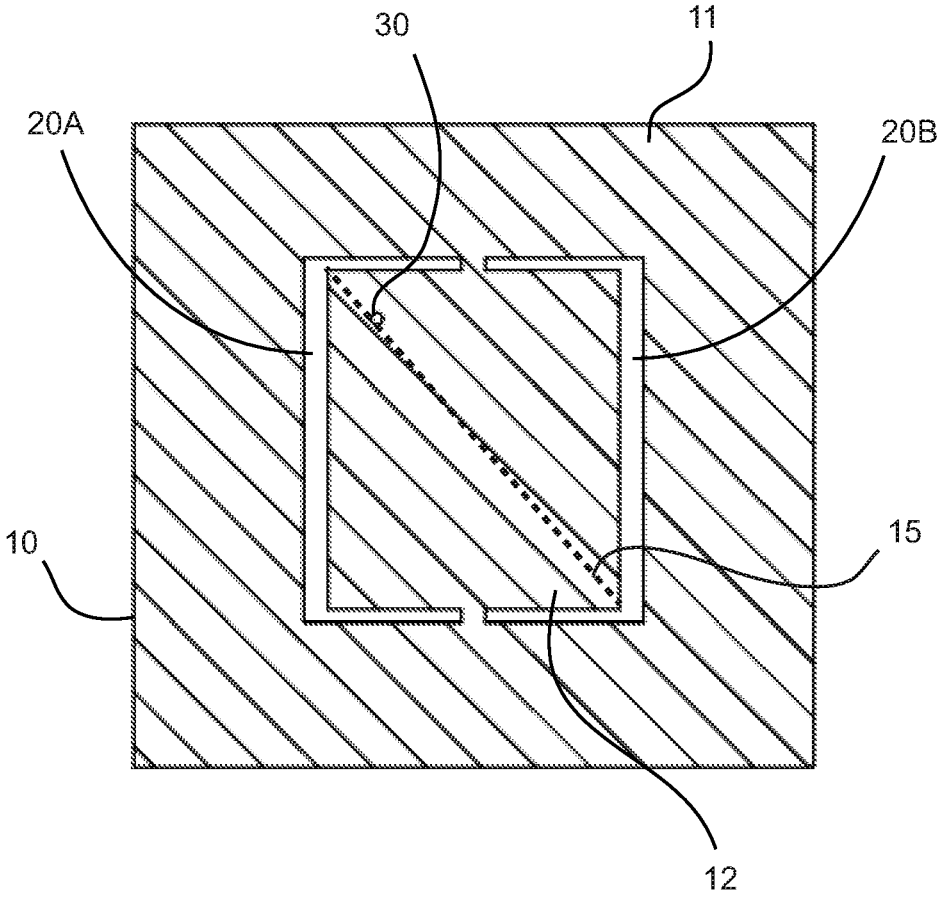
FIG. 1 shows a microstrip patch antenna having a pair of opposing u-shaped slots embedded therein.

Turning to FIG. 1, the microstrip patch antenna 10 is shown having a pair of opposing u-shaped slots 20A; 20B disposed thereon. The u-shaped slots form an outer patch volume 11 defined by an area of the conductor disposed outside of the opposing u-shaped slots, and an inner rectangular patch volume 12 defined by an area of the conductor disposed within the opposing u-shaped slots. An antenna feed 30 is coupled to the patch at the inner rectangular patch volume, and preferably adjacent to a corner of a first of the two opposing u-shaped slots as shown, or along an imaginary diagonal line 15 dividing the inner rectangular patch volume, the imaginary diagonal line extending from an upper corner of a first of the u-shaped slots to a lower corner of a second of the u-shaped slots.

Figure 2:
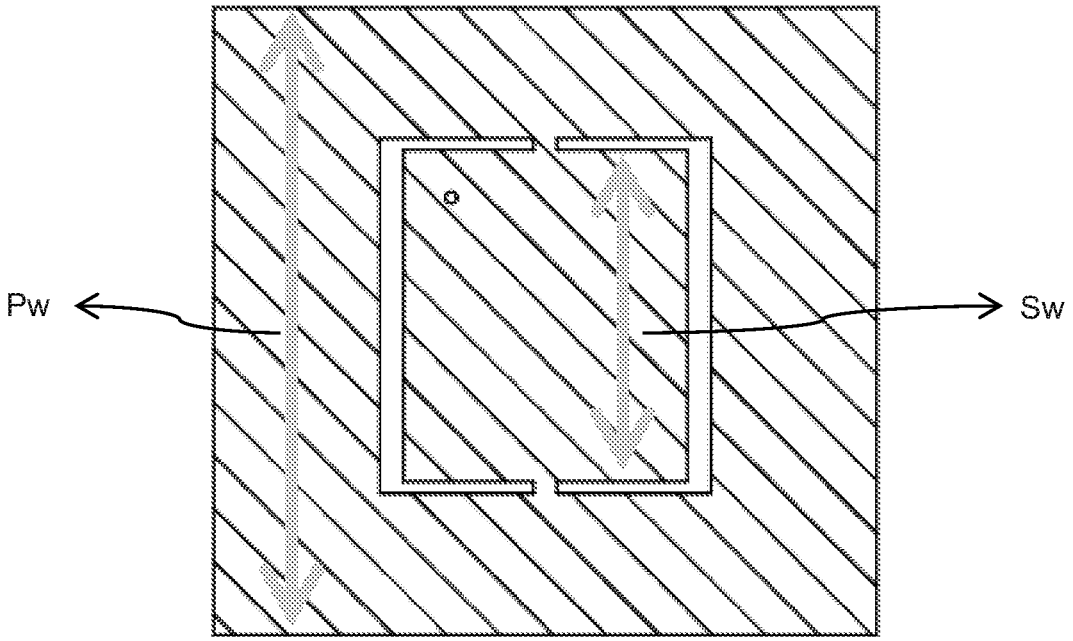
FIG. 2 shows a patch width associated with a low frequency resonance, and a slot width associated with a high frequency resonance of the antenna.

FIG. 2 shows a patch width (Pw) associated with a low frequency resonance and a slot width (Sw) associated with a high frequency resonance of the antenna. Although the patch antenna having dual opposing u-shaped slots is illustrated in an embodiment configured for 3.4 GHz, and 5.2/5.8 GHz bands for WiFi applications, it should be recognized that the Pw and Sw dimensions can be configured for any desired resonances, respectively.

Figure 3:
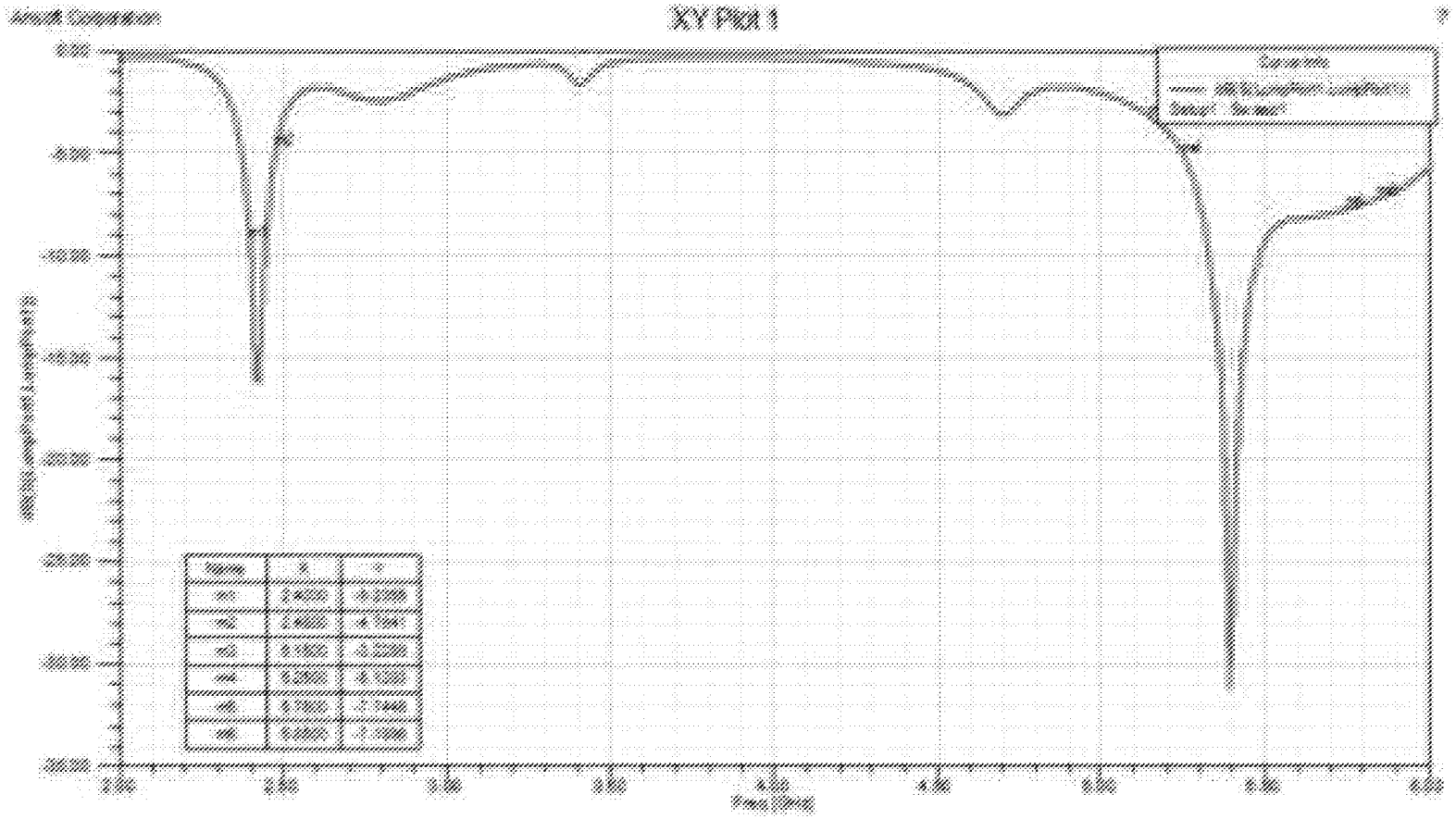
FIG. 3 shows a two dimensional plot of the antenna radiation pattern illustrating resonances of the antenna of FIGS. 1-2, the resonances including 2.4 GHz and 5.2/5.8 GHz.

FIG. 3 shows a two dimensional plot of the antenna radiation pattern illustrating resonances of the antenna of FIGS. 1-2, the resonances including 2.4 GHz and 5.2/5.8 GHz. In this regard, the antenna is configured for dual-band operation, including a first band at 2.4 GHz and a second band at 5.2/5.8 GHz.

Figure 4:
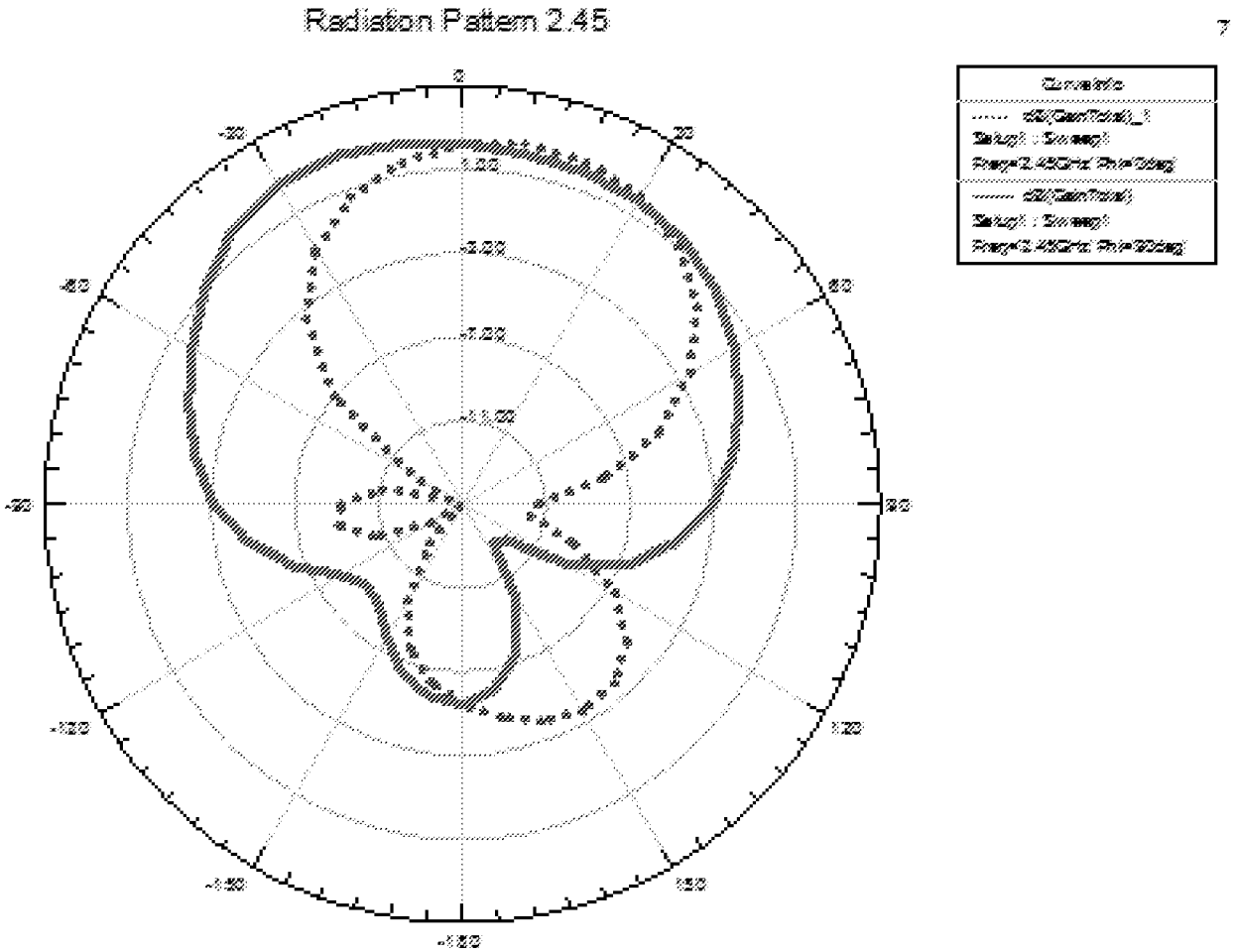
FIG. 4 shows a plot of the radiation pattern for the 2.4 GHz resonance of the antenna of FIGS. 1-2.

FIG. 4 shows a plot of the radiation pattern for the 2.4 GHz resonance of the antenna of FIGS. 1-2.

Figure 5:
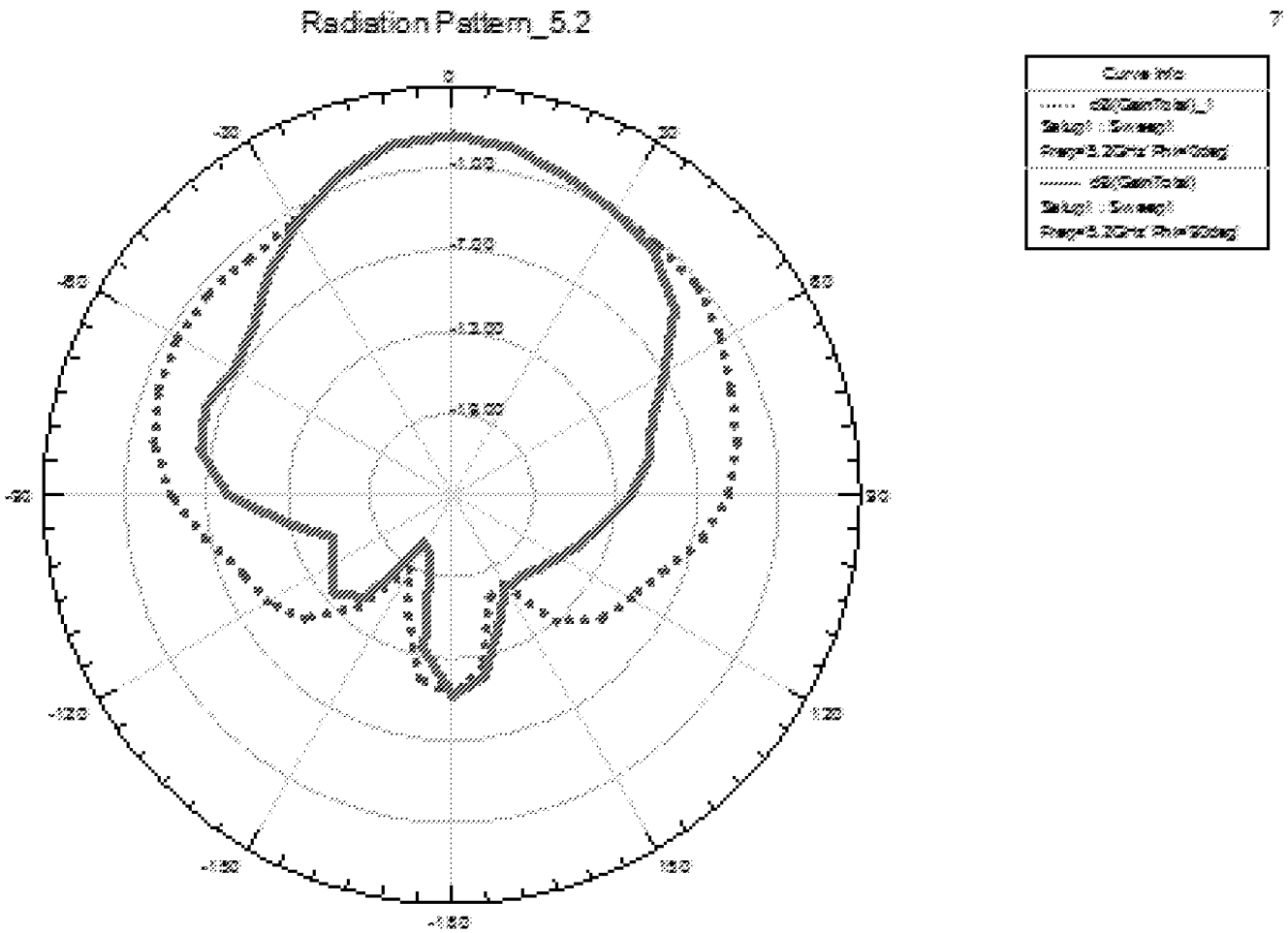
FIG. 5 shows a plot of the radiation pattern for the 5.2 GHz resonance of the antenna of FIGS. 1-2.

FIG. 5 shows a plot of the radiation pattern for the 5.2 GHz resonance of the antenna of FIGS. 1-2.

Figure 6:
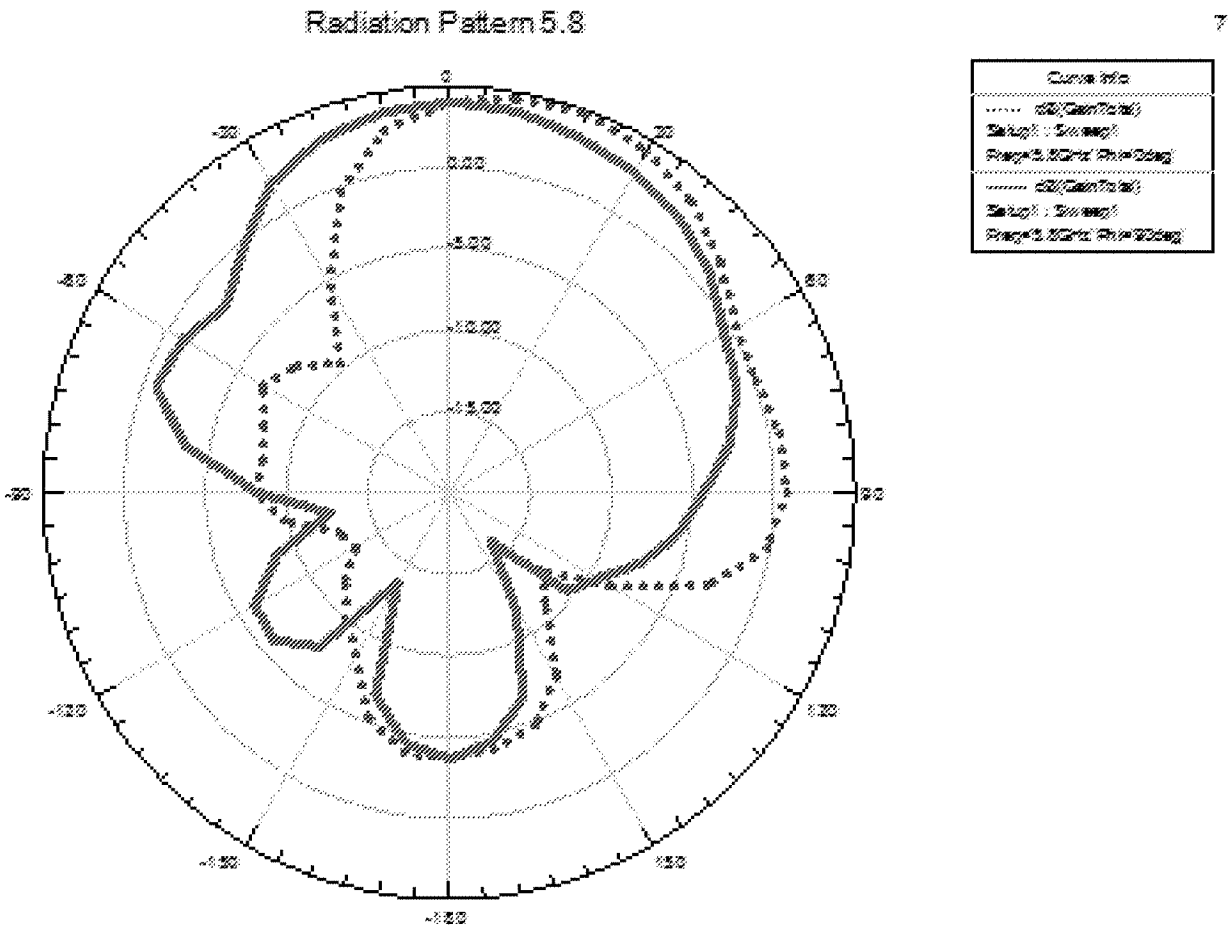
FIG. 6 shows a plot of the radiation pattern for the 5.8 GHz resonance of the antenna of FIGS. 1-2.

FIG. 6 shows a plot of the radiation pattern for the 5.8 GHz resonance of the antenna of FIGS. 1-2.

Accordingly, the antenna as shown and described can have broadside radiation pattern in both Wi-Fi 2.4 GHz and Wi-Fi 5.2 GHz/5.8 GHz.

When designing a patch antenna having opposing u-shaped slots, the following method can be considered. First, place the feed point at a location on the patch conductor for achieving good impedance characteristics. Second, vary each of the patch width (Pw) and slot width (Sw) for the opposing u-shaped slots to produce the desired resonances. In order to reduce the size of the patch conductor, a high dielectric constant material can be used as a base for attaching with the patch antenna.

The antenna can generally include the above-described microstrip patch conductor having opposing dual u-shaped slots embedded therein, with a feed point located along an imaginary diagonal line dividing the inner patch volume from an upper corner of a first u-shaped slot to a lower corner of a second of the dual u-shaped slots. In addition, the microstrip patch may be positioned on a high dielectric constant substrate. The microstrip patch and substrate can be further positioned on a ground plane, with the ground plane optionally positioned on a second substrate of desired dielectric properties. The entire antenna assembly, including the patch conductor, substrate(s) and ground plane can be configured with solder pads for surface-mounting on a device printed circuit board (PCB) by way of passing through a reflow oven (surface mount technology).

What is claimed is:

1. An antenna, comprising:

a rectangular conductor having a patch width configured to produce a first resonance;

a pair of u-shaped slots embedded in the rectangular conductor, the u-shaped slots oriented in opposing directions and having a diagonal line extending from an upper corner of a first of the u-shaped slots to a lower corner of a second of the u-shaped slots; and a feed coupled to the rectangular conductor at a point along the diagonal line;

wherein an area disposed outside of the pair of u-shaped slots forms an outer patch volume.

2. The antenna of claim 1, wherein the u-shaped slots comprise a slot width dimensioned to resonate at a second frequency.

3. The antenna of claim 2, wherein the second frequency includes 5.2 GHz.

4. The antenna of claim 2, wherein the second frequency includes 5.8 GHz.

5. The antenna of claim 1 configured for operation in WiFi bands.

6. The antenna of claim 1, wherein an area disposed inside the pair of u-shaped slots forms an inner patch volume.

7. The antenna of claim 1, wherein the patch conductor comprises a patch width dimensioned to resonate at a first frequency.

8. The antenna of claim 7, wherein the first resonance comprises 2.4 GHz.

* * * * *